US006164729A

United States Patent [19]

Dibenedetto et al.

[11] Patent Number: 6,164,729

[45] **Date of Patent: *Dec. 26, 2000**

[54] SKATE WHEEL AND METHOD OF APPLYING INDICIA TO A PORTION OF A SKATE WHEEL

[75] Inventors: Christian Dibenedetto; Daniel James Richards, both of Hillsboro, Oreg.

[73] Assignee: Nike, Inc., Beaverton, Oreg.

[ * ] Notice: This patent issued on a continued prosecution application filed under 37 CFR 1.53(d), and is subject to the twenty year patent term provisions of 35 U.S.C. 154(a)(2).

[21] Appl. No.: 09/008,564

[22] Filed: Jan. 16, 1998

[51] Int. Cl.[7] ..... A63C 17/22

[52] U.S. Cl. ..... 301/5.3; 152/195; 152/165; 152/DIG. 18; 156/116; 156/118; 156/277

[58] Field of Search ..... 156/110.1, 277, 156/387, 116, 118; 301/5.3, 64.7; D21/764; 152/154.2, 195, 524, DIG. 18, 165

[56] References Cited

U.S. PATENT DOCUMENTS

| | | | |
|---|---|---|---|
| 565,795 | 8/1896 | Reach . | |
| 979,169 | 12/1910 | Kennedy . | |
| 988,533 | 4/1911 | Zverina . | |
| 1,035,424 | 8/1912 | Rice . | |
| 1,539,445 | 5/1925 | Buuren . | |
| 2,168,820 | 8/1939 | Edstrom . | |
| 2,241,685 | 5/1941 | Ware . | |
| 2,262,714 | 11/1941 | Ware . | |
| 3,877,710 | 4/1975 | Nyitrai . | |
| 4,040,670 | 8/1977 | Williams | 301/5.3 |
| 5,028,058 | 7/1991 | Olson . | |
| 5,048,848 | 9/1991 | Olson et al. . | |
| 5,129,709 | 7/1992 | Klamer . | |
| 5,190,301 | 3/1993 | Malewicz . | |
| 5,308,152 | 5/1994 | Ho . | |
| 5,310,250 | 5/1994 | Gonsior . | |
| 5,320,418 | 6/1994 | Chen . | |
| 5,346,231 | 9/1994 | Ho . | |
| 5,460,433 | 10/1995 | Hawley . | |
| 5,470,086 | 11/1995 | Peterson et al. . | |
| 5,524,913 | 6/1996 | Kulbeck . | |
| 5,564,790 | 10/1996 | Lekavich . | |
| 5,641,365 | 6/1997 | Peterson et al. | 152/165 |
| 5,908,519 | 6/1999 | Piper et al. | 152/165 |
| 5,979,993 | 11/1999 | Huang | 301/5.3 |

FOREIGN PATENT DOCUMENTS

| | | | |
|---|---|---|---|
| 393869 | 1/1909 | France . | |
| 4067 | of 1894 | United Kingdom . | |
| 3372 | of 1897 | United Kingdom . | |
| 346476 | 4/1931 | United Kingdom . | |
| WO 96/18513 | 6/1996 | WIPO | 152/165 |

OTHER PUBLICATIONS

Oxygen®, get Outta Our Way !, dated 1997.
Hyper Wheels, dated 1996.
Global Skate, Industry Innovations, dated Feb./Mar. 1997.

*Primary Examiner*—Michael W. Ball
*Assistant Examiner*—Gladys Piazza
*Attorney, Agent, or Firm*—Banner & Witcoff, Ltd.

[57] ABSTRACT

An in-line skate wheel and a applying indicia to a part thereof so that the indicia does not wear off before the wheel needs to be replaced. The skate wheel includes a hub having an internal bearing surface and an outer surface, a see-through tire formed about a portion of the hub and an element, such as a bladder, including indicia on an outer side thereof being positioned within the see-through tire. The method according to the present invention includes applying indicia to an element adapted to be located within a see-through material. The method comprises the steps of providing a bladder for locating within the see-through material and applying a first set of indicia on a first side surface of the bladder such that the indicia is visible when the bladder is viewed from a first side. The method also includes applying a second set of indicia on a second side surface of the bladder such that the second indicia set is visible when the bladder is viewed from the first side. The method further comprises the step of surrounding at least a portion of the bladder with the see-through material.

31 Claims, 4 Drawing Sheets

SKATE WHEEL AND METHOD OF APPLYING INDICIA TO A PORTION OF A SKATE WHEEL

REFERENCE TO RELATED APPLICATION

This application is related to the U.S. Patent Application of Carl Madore and Christian DiBenedetto entitled "SKATE WHEEL" filed concurrently herewith and which is herein incorporated by reference.

FIELD OF THE INVENTION

The present invention relates to a method of applying indicia to an element contained within a see-through material. More particularly, the present invention relates to a process for applying indicia to an element contained within the see-through tire of a skate wheel. The present invention also relates to a see-through skate wheel containing an element with applied indicia.

BACKGROUND OF THE INVENTION

In-line skates include a series of wheels that are longitudinally arranged one behind the other along the length of a frame. These wheels normally rotate in a common, vertical plane creating an experience that is similar to ice skating. In-line skating, including recreational, hockey, aggressive and speed, has experienced a considerable increase in its popularity over the last decade. In recent years, in-line skates have become an increasingly popular recreational and off season training activity. This is in part due to its combining the excitement and challenge of ice skating with the freedoms of running. In-line skates enable a user to access a variety of smooth and rough indoor and outdoor surfaces including composite rubber floors, concrete and asphalt.

Conventional in-line skate wheels are traditionally either solid or pneumatic. Solid wheels are usually very hard and formed of rubber, plastic or other appropriate materials. Pneumatic skate wheels include a bladder or fluid receiving area that dampens vibrations created during skating and provides the skater with a more comfortable ride. These wheels also give the skater the option of using a softer or harder tire depending on the type of skating to be done. Pneumatic skate wheels can be lighter than solid wheels of the same size, as a result, they can significantly reduce the overall weight of a skate, especially, when the skate requires four or more wheels.

Indicia, such as lettering and symbols, are typically applied to the outer, lateral sides of conventional in-line skate wheels to identify the source of the wheels, provide specification information about the wheels and make the wheels more attractive to the public. An example of a wheel having indicia applied to its exterior is the "C.S. MATRIX" by HYPER. However, as the tire portion of a wheel wears down due to frictional contact with rough skating surfaces such as asphalt, concrete and rubber floors, the indicia wears off before the wheel needs to be replaced. The indicia can also wear off as a consequence of being hit by a puck or stick, or if the skater drags the side of the skate carrying the detailing while stopping, skating or performing maneuvers. As a result, the resources used to provide detailing to the side of the wheel can be wasted if the detailing prematurely wears off the wheel.

There is a decided need in the art for in-line skate wheels that overcomes the disadvantages of the prior art. It is an object of this invention to provide a method of applying indicia to a portion of an in-line skate wheel that will not wear off before the wheel is replaced.

SUMMARY OF THE INVENTION

The present invention relates to an in-line skate wheel and a method of applying indicium to a part thereof so that the indicium does not wear off before the wheel needs to be replaced. The skate wheel according to the present invention comprises a hub for coupling a tire to an axle, a see-through tire formed about a portion of the hub and an element including indicia on an outer side thereof being positioned within the see-through tire.

The present invention includes a method of applying indicia to an element adapted to be located within a see-through tire material. The method comprises the steps of providing an element for locating within the see-through material and applying a first set of indicia on a first side surface of the element such that the indicia is visible when the element is viewed from a first side. The method also comprises the step of surrounding at least a portion of the element with the see-through material. The method further includes applying a second set of indicia on a second side surface of the element such that the second indicia set is visible when the element is viewed from the first side.

A method of applying indicia to a portion of a wheel having a see-through tire according to the present invention comprises the steps of providing an element adapted to be positioned within the see-through tire and applying a first set of indicia on a first side surface of the element such that the indicia is visible when the element is viewed from a first side and a mirror image of the indicia is visible when the element is viewed from a second side opposite the first side. The method also comprises applying a second set of indicia on a second side surface of the element such that the second set of indicia is visible when the element is viewed from the first side and a mirror image of the second set of indicia is visible when the element is viewed from the second side. According to the present invention, the element includes a see-through or opaque bladder and the applying steps include stamping, pressing, printing or screening the indicia onto the bladder.

The present invention also includes a method of forming a wheel including a see-through tire. The method comprises the steps of providing and inflating a bladder adapted for locating within a wheel about a hub, applying a first set of indicia on a first side surface of the bladder such that the indicia is visible when the bladder is viewed from a first side. The method also includes applying a second set of indicia on a second side surface of the bladder such that the second set of indicia is visible when the bladder is viewed from a second side. The method further comprises the steps of positioning the bladder on the hub so that the bladder is positioned above an outer surface of the hub and molding a tire about a portion of the hub and about at least a portion of the bladder with the indicia printed thereon.

The indicia are applied to both sides of the bladder in such a manner that both sets can be read from a single side of the wheel, i.e., the lateral side, and so that a mirror image of the indicia is seen from the opposite side of the wheel, i.e., the medial side. The location and application of the indicia along with their staggered positioning, so that no letter or symbol is blocked from being viewed, allows the indicia to be viewable at the end of the life span of the wheel. Applying indicia to both sides of the bladder also gives depth to the bladder and the wheel.

By encasing the bladder carrying the indicia within the tire material, the present invention requires the tire to wear off the sides of the wheel before the indicia will begin to wear. The indicia will not prematurely wear off the wheel because it can not begin to wear until the tire reaches an unusable state. As a result, the indicia showing the specifications of the wheel, such as the diameter and the durometer, will still be available for reference by the user after the outer surface of the tire has been worn away. The indicia, suspended within the tire, also informs a user that a bladder is contained within the wheel. Identifying the presence of a bladder notifies the user that the pneumatic wheel will provide the comfort and performance advantages discussed above.

DETAILED DESCRIPTION OF THE INVENTION

Figure 1:
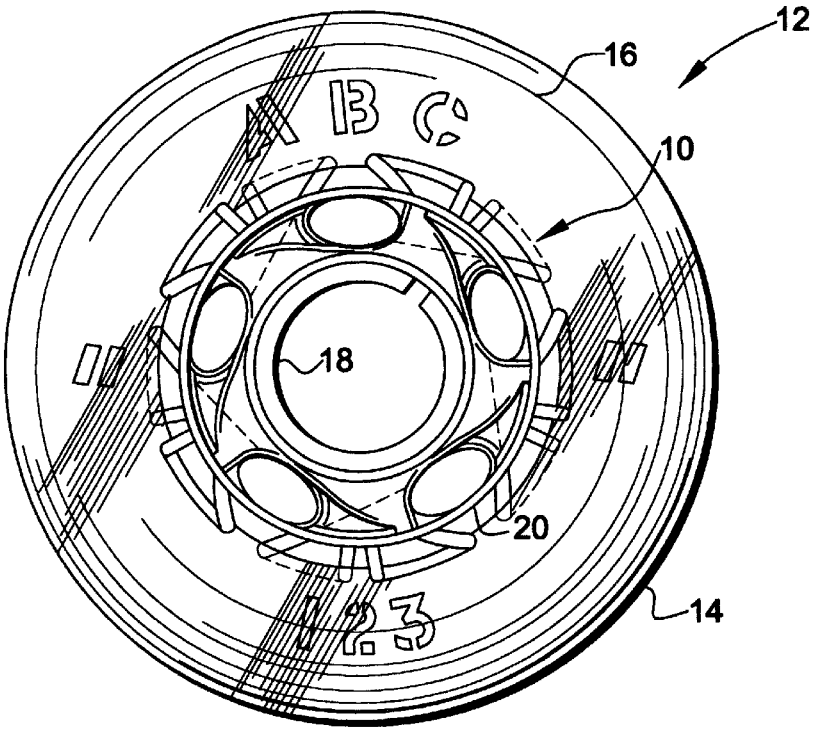
FIG. 1 is a side elevational view of a wheel including a bladder carrying indicia according to the present invention.

An in-line skate wheel 12 according to the present invention includes an outer tire member 14 formed of an annulus of resilient, yieldable, see-through urethane material molded about a wheel hub 10 or 10' as discussed in co-pending U.S. Patent Application to Carl Madore and Christian DiBenedetto, titled "Skate Wheel", which is herein incorporated by reference. The see-through urethane material includes those known skate wheel tire materials that are transparent, including semi-transparent, and/or translucent, including semi-translucent. Encapsulated within the tire 14 is a centrally spaced bladder 16 having indicia on at least one of its inner or outer surfaces. The inner surfaces of the bladder can also include a member suspended within bladder 16. Tire 14 could include a banner or circular sheet of elastomeric material, such as that discussed above, positioned about hub 10. Indicia used on wheel 12 can include a letter, a word, a symbol, a character, a figure, markings or a combination of all or some of these.

Hub 10 has an inner surface 18 for receiving the bearings and axle for in-line skate wheel 12. The inner surface 18 is configured to receive the outer races of bearing assemblies commonly used with in-line skate wheels. Hub 10 also includes an outer circumferential surface 20 spaced from the inner surface 18 and having first and second side edges 22, 24 spaced on opposite sides of a center line 26. A plurality of positioning tabs 30 are located along the circumferential outer surface 20 and are configured for positioning and supporting bladder 16 to ensure its proper placement within wheel 12, such that bladder 16 including its inner flange 21 is completely out of contact with outer circumferential surface 20. Positioning tabs 30 are alternately spaced so that at least two successive tabs are located on opposite sides of the center line of the hub. Preferably, tabs 30 are positioned so that each circumferentially successive tab is located on the opposite side of center line 26 from the previous tab 30 so that adjacent tabs 30 do not overlap one another in the circumferential direction. Alternate spacing of the tabs 30 facilitates the placing of bladder 16 on hub 10 by allowing the bladder to flex between the gaps in the tab arrangement, thereby making it easier for the bladder to be snapped over the alternating tabs 30 and properly positioned on hub 10. Tabs 30 also allow a tire material such as urethane to flow directly to and around the bladder during manufacture so that a chemical bond between the bladder and the tire material is formed. The number of supporting tabs can vary depending on the size of the hub and bladder.

In one preferred embodiment, bladder 16 is formed of two annular sheets of see-through elastomeric material 17, 19 having a thickness of 0.030 to 0.060 mm. As discussed above, see-through materials include materials that are transparent, including semi-transparent, and/or translucent, including semi-translucent. Materials used to form bladder 16 include polyester polyurethane, polyether polyurethane or the additional suitable materials identified in the '156 and '945 patents. Among the numerous thermoplastic urethanes which are particularly useful in forming the film layers are urethanes such as Pellethane™, (a trademarked product of the Dow Chemical Company of Midland, Mich.), Elastollan® (a registered trademark of the BASF Corporation) and ESTANE® (a registered trademark of the B. F. Goodrich Co.), all of which are either ester or ether based and have proven to be particularly useful. Still other thermoplastic urethanes based on polyesters, polyethers, polycaprolactone and polycarbonate macrogels can be employed. Sheets 17 and 19 are connected along an inner circumferential flange 21 and an outer circumferential flange 29, by a conventional technique such as welding. It is also possible to use non-transparent sheets, colored sheets, or sheets having a pre-printed graphic, such as, for example, a checker board pattern, for the outer or barrier layer of bladder 16. Bladder 16 is manufactured using known techniques, such as those described in U.S. Pat. Nos. 4,183,156 and 4,219,945 to Marion F. Rudy, the contents of which are hereby expressly incorporated by reference. Sheets 17 and 19 are preferably connected along an inner circumferential flange 21 and an outer circumferential flange 29, using conventional technique such as welding.

Figure 9:
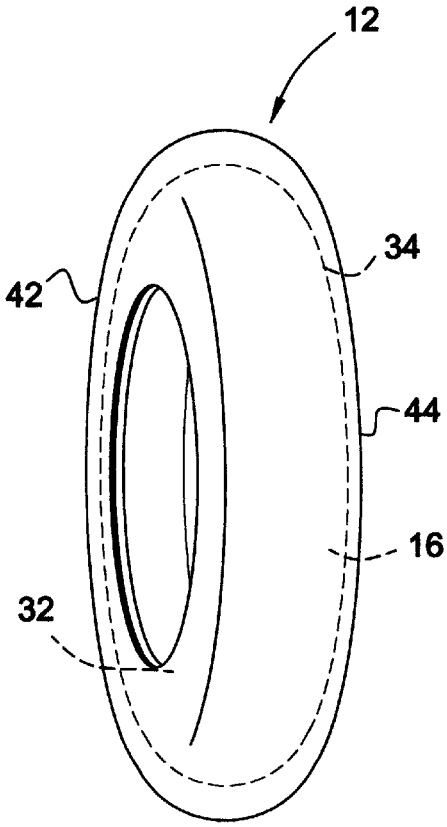
FIG. 9 is an end perspective view of the wheel shown in FIG. 1.

Bladder 16 is inflated under pressure with a supportive, cushioning gaseous fluid, for example, sulfur hexafluoride ("supergas"), air, or one of the other suitable gases which are identified in the '156 and '945 patents, such as: hexafluoroethane; perfluoropropane; perfluorobutane; perfluoropentane; perfluorohexane; perfluoroheptane; octafluorocyclobutane; perfluorocyclobutane; hexafluoropropylene; tetrafluoromethane; monochloropentafluoroethane; 1, 2-dichlorotetrafluroethane; 1, 1, 2-trichloro-1, 2, 2 trifluoroethane; chlorotrifluoroethylene; bromotrifluoromethane; and monochlorotrifluoromethane. These gases may all be termed "supergases". In a preferred embodiment of the present invention, the bladder is inflated with sulfur hexafluoride to provide a consistent and enduring inflation pressure. When filled, bladder 16 takes on a configuration where sheets 17 and 19 balloon away from one another, such as shown in FIG. 9. Preferably, bladder 16 is filled to a pressure in the range of 0 to 60 psi with the preferred range being between 25 psi to 35 psi prior to introducing the material of tire 14.

Hub 10 is positioned within a mold and mounted on a spindle. After securing the hub and mold on the spindle, liquid urethane tire material is introduced into the mold to form the tire member. Preferably, a portion of the mold is open so that the liquid urethane can be poured into it. It is also possible to introduce the urethane into the mold by injection. After the urethane cures, hub 10 is finished by removing any part of it that extends laterally beyond the sides of wheel 12 or a predetermined distance away from wheel 12.

The introduction of the hot liquid urethane tire material causes bladder 16 to expand and fill in at least some of the contoured areas in tabs 30. Contoured tabs 30 support bladder 16 above outer circumferential surface 20 so that the tire material flows under bladder 16 and between bladder 16 and the tab 30 to chemically bond with bladder 16 and mechanically bond with tabs 30 and the entire outer circumferential surface 20. The shape and orientation of tabs 30 allow the tire material and air bubbles created during the pouring of the tire material to flow between and through tabs 30 and along surface 20.

Indicia such as lettering, symbols and figures are placed on the bladder to identify characteristics of the wheel such as its model, hardness and size. They can also be used to identify the source of the wheel and its intended use, such as recreational, hockey or aggressive skating. In a preferred embodiment, the material used for the indicium must be able to bond with the bladder and resist the heat of the tire material when poured. The indicia material typically include inks or paints. Preferred inks include those typically used to apply indicia to the external surface of urethane tires. These inks include polyurethane or epoxy inks. One such ink that can be used on the urethane bladder is UP82 available from United Silicone. However, other materials which are capable of bonding with a bladder and resisting the heat of the poured tire material may also be used. Stickers can be used to place indicia on the bladder, however, they can move during the pouring of the tire material and may not be able to withstand the heat of the poured tire material or the heat generated within the wheel while skating.

The indicia are applied to inflated bladder 16 using well known printing techniques such as pad printing so that the ink does not stretch or deform from its printed form. The indicia could also be applied to the barrier material before the bladder is cutout or assembled. Furthermore, the indicia could also be applied to the bladder before it is inflated, such as when the indicia is intended to be placed on the interior of bladder 16. Pad printing is a well known form for printing on the exterior of urethane wheels. The bladders to be printed upon are secured to a substrate and moved from color station to color station. It is also possible for the color stations to move with respect to a stationary bladder. Each color station can include a mechanism that allows accurate indicia registration from color station to color station. For pad printing, each color station is also equipped with a cone shaped pad having the correct letters, symbols or markers for its respective color. The pad is first dipped into its ink and then applied to the bladder material to transfer the indica to the surface of the bladder. Certain indicia may need to be double hit as a result of their shape. After the application of one color is completed, the bladder material is moved to the next color station.

Other techniques such as sublimation printing; air brushing; screen printing; the application of labels, stickers or colored film; spraying; and rolling could also be used in place of the pad printing discussed above. The indicia can be simultaneously applied to both sides of the bladder or they can be applied to one side at time. In a preferred embodiment, the indicia are simultaneously printed on each side of bladder 16 in a single step. However, no matter the application technique, it is preferable to apply the indicia to the bladder after it is inflated so the indicia does not crack, pull away from the bladder or distort during inflation. Also, if enough ink is not used during pre-inflation printing, inflation of the bladder can result in the ink stretching and thinning out.

Figure 2:
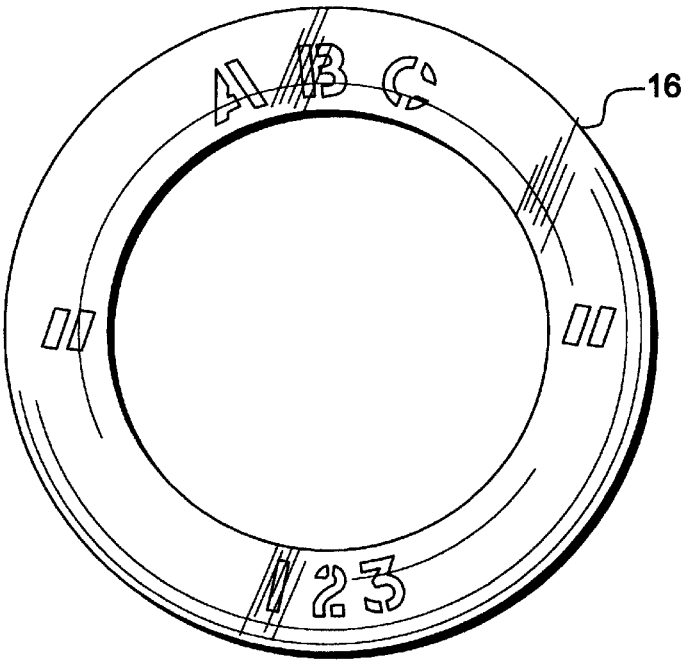
FIG. 2 is a side elevational view of the bladder having indicia according to the present invention.
Figure 3:
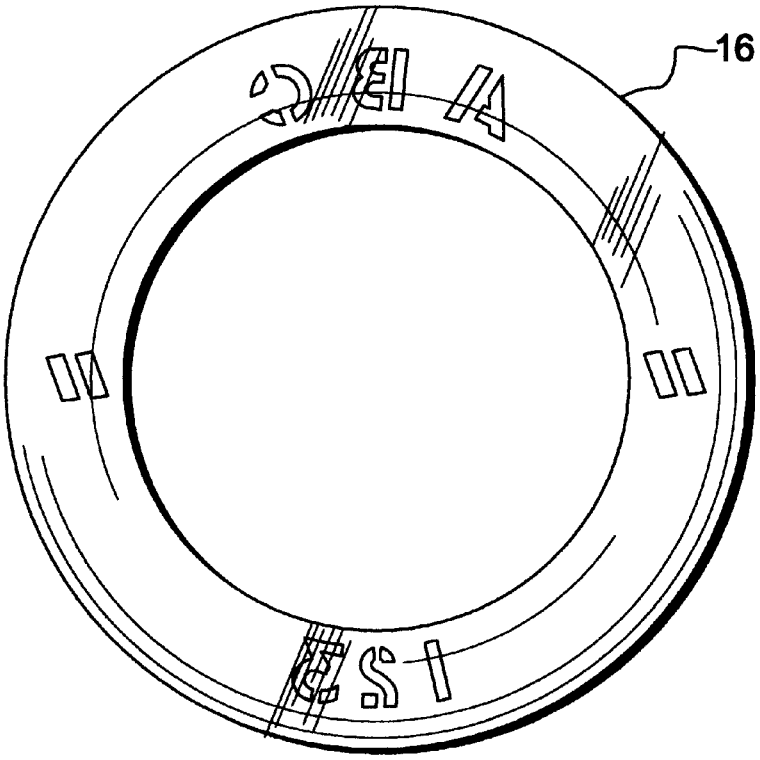
FIG. 3 is a side elevational view of the bladder from the opposite side of FIG. 2.
Figure 4:
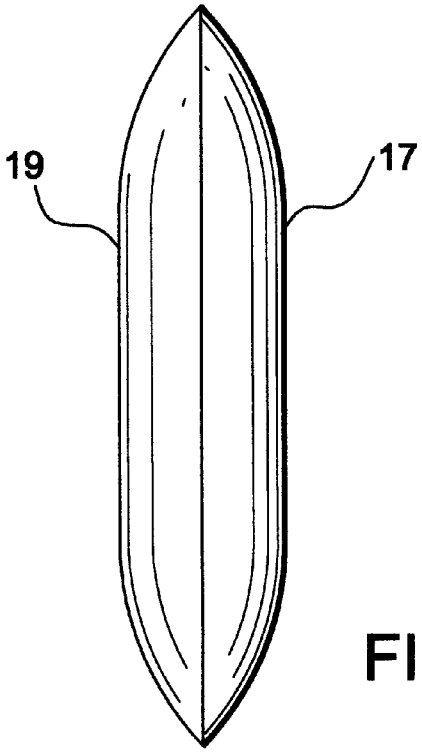
FIG. 4 is an end elevational view of the bladder.
Figure 5:
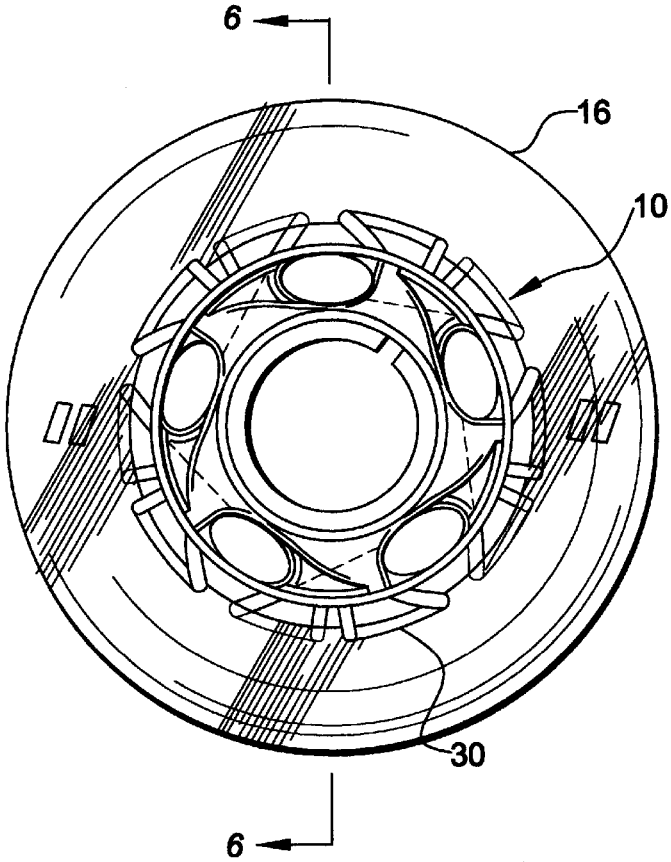
FIG. 5 is a side elevational view of a wheel hub including the bladder shown in FIG. 1.
Figure 6:
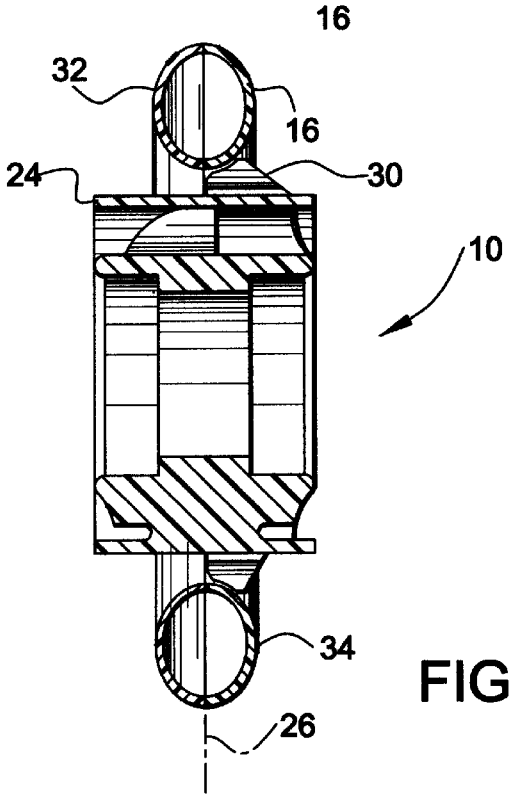
FIG. 6 is a cross-sectional view taken along the lines 6—6 of FIG. 5.
Figure 7:
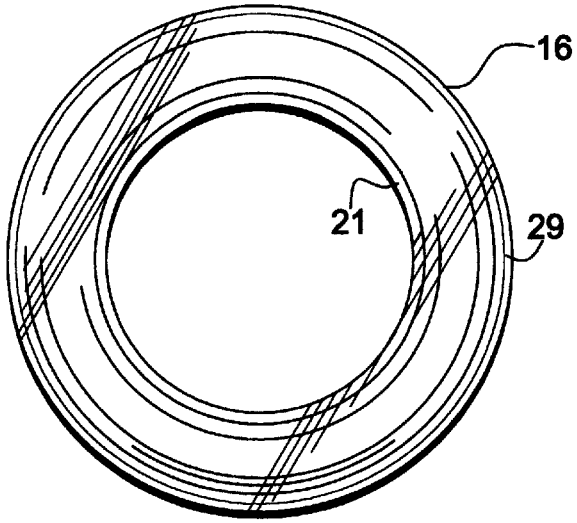
FIG. 7 is a side elevational view of the bladder shown in FIG. 1 without indicia.
Figure 8:
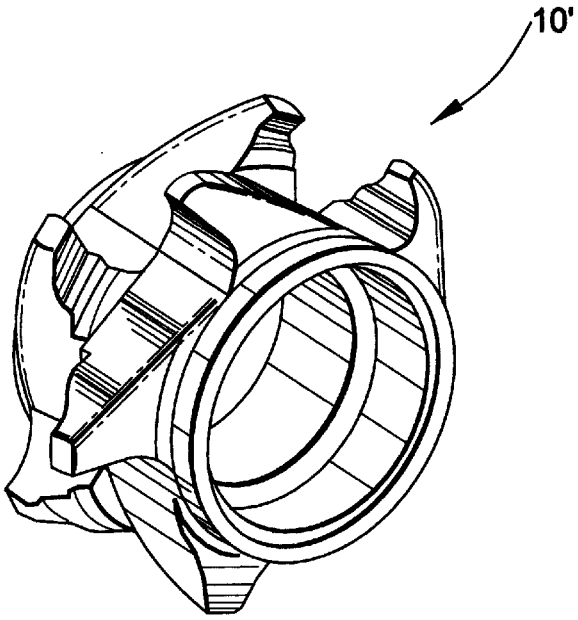
FIG. 8 is a perspective view of a second embodiment of the hub according to the claimed invention.

Indicia (shown in the figures as letters, numbers and symbols) are provided on the first side 32 of bladder 16 so they can be read in a conventional manner, e.g., from left to right when wheel 12 is viewed from that side. Preferably, the first side 42 of wheel 12 corresponds to the lateral side of the skate. Indicia are provided on the second side 34 of bladder 16 in such a way that they can also be read in a conventional manner, e.g., from left to right from the first side 42 of wheel 12. As shown in FIG. 3, the mirror image of the indicia applied to both sides of bladder 16 will be seen when viewed from the second side 44 of wheel 12. As clearly seen in FIGS. 1–3, the indicia may be asymmetrical. Second side 44 of wheel 12 is opposite first side 32 and preferably corresponds to the medial side of the skate.

The indicia on each side 32, 34 are spaced apart along the circumference of bladder 16 so that the indicia on the opposite side are visible therethrough. In other words, the indicia on the second side 34 can be seen through the spaces between the indicia on the first side 32 when the wheel is viewed from side 42. The same is true of the mirror image of the indicia. The mirror image of the indicia on the first side 32 can be seen between the indicia on the second side 34 of bladder 16 when the wheel is viewed from second side 44.

The process of applying indicia according to the present invention can also be used on other bladder surfaces such as those used in street lunge wheels or skate board wheels. The process can also be used on bladders within the sole of an article of footwear. Applying the indicia to these bladders is essentially the same as that discussed above and must be done before the inner bladder layer is surrounded by an outer material. It is preferable that the indicia be applied after the internal bladder has been inflated. However, as discussed above, it could be applied before the bladder has been assembled or inflated. In another embodiment, tire 14 could include a banner or circular sheet of elastomeric material, such as that discussed above, positioned about hub 10.

Numerous characteristics, advantages and embodiments of the invention have been described in detail in the foregoing description with reference to the accompanying drawings. However, the disclosure is illustrative only and the invention is not limited to the illustrated embodiments. Various changes and modifications may be effected therein by one skilled in the art without departing from the scope or spirit of the invention.

We claim:

1. A method of applying indicia to a portion of a wheel having a see-through tire, said method comprising the steps of:

providing an element adapted to be positioned within said see-through tire, the element having first and second side surfaces;

applying a first asymmetrical indicium on the first side surface of said element such that said first asymmetrical indicium is visible when said element is viewed from a first side and a mirror image of said first asymmetrical indicium is visible when said element is viewed from a second side opposite said first side; and applying a second asymmetrical indicium on the second side surface of said element such that said second asymmetrical indicium is visible when said element is viewed from said second side and a mirror image of said second asymmetrical indicium is visible when said element is viewed from said firs side, said second asymmetrical indicium being a mirror image of said first asymmetrical indicium.

2. The method of applying indicia to a portion of a wheel according to claim 1 wherein said element includes a see-through bladder and said applying steps include stamping said first and said second asymmetrical indicia on said bladder.

3. The method of applying indicia to a portion of a wheel according to claim 1 further including the step of positioning said element on a hub within said wheel and encasing said element and a portion of said hub with a see-through tire material.

4. The method of applying indicia to a portion of a wheel according to claim 1 wherein said element is a see-through bladder and said applying steps include rolling said first and said second asymmetrical indicium onto a surface of said bladder.

5. The method of applying indicia to a portion of a wheel according to claim 1 wherein said element is a see-through bladder and said applying steps include printing said first and said second asymmetrical indicium onto a surface of said bladder.

6. The method of applying indicia to a portion of a wheel according to claim 1 wherein said element is a see-through bladder and said applying steps include applying said first and said second asymmetrical indicium onto a surface of said bladder using a pad.

7. The method of applying indicia to a portion of a wheel according to claim 1 wherein said first asymmetrical indicium includes at least one letter and wherein said letter is applied so that its reverse can be seen when viewed from said second side.

8. The method of applying indicia to a portion of a wheel according to claim 1 wherein said applying steps occur simultaneously.

9. The method of applying indicia to a portion of a wheel according to claim 1 wherein said element is a see-through bladder, and said method further comprises the step of inflating said bladder before applying said first and said second asymmetrical indicia.

10. The method of applying indicia to a portion of a wheel according to claim 1 wherein said applying steps include applying portions of said second asymmetrical indicium so that they are offset from portions of said first asymmetrical indicium such that said offset portions of said second asymmetrical indicium can be seen from both sides of said wheel.

11. A method of applying indicia to a bladder adapted to be located within a sec-through tire material, said method comprising the steps of:

providing a bladder for locating within said see-through tire material;

inflating said bladder;

applying a first set of indicia to a first side surface of said inflated bladder such that said first set of indicia is visible when said inflated bladder is viewed from a first side; and surrounding at least a portion of said inflated bladder with said see-through material.

12. The method of applying indicia to a bladder according to claim 11 further comprising the step of applying a second set of indicia on a second side surface of said inflated bladder such that said second set of indicia is visible when said inflated bladder is viewed from said first side.

13. The method of applying indicia to a bladder according to claim 12 wherein a mirror image of said first set of indicia is visible when said inflated bladder is viewed from a second side opposite said first side, and a mirror image of said second set of indicia is visible when said inflated bladder is viewed from said second side.

14. The method of applying indicia to a bladder according to claim 11 further including the step of positioning said inflated bladder on a hub, and wherein said surrounding step also includes surrounding a portion of said hub with said see-through tire material.

15. The method of applying indicia to a bladder according to claim 11 wherein said bladder is a see-through bladder and said applying step includes rolling said first set of indicia onto a surface of said inflated bladder.

16. The method of applying indicia to a bladder according to claim 11 wherein said bladder is a see-through bladder and said applying step includes printing said first set of indicia onto a surface of said inflated bladder.

17. The method of applying indicia to a bladder according to claim 11 wherein said bladder is a see-through bladder and said applying step includes spraying said first set of indicia onto a surface of said inflated bladder.

18. The method of applying indicia to a bladder according to claim 12 wherein said applying steps occur simultaneously.

19. The method of applying indicia to a bladder according to claim 12 wherein said applying steps include applying portions of said second set of indicia so that they are offset from portions of said first set of indicia such that said offset portions of said second set of indica can be seen from both sides of said inflated bladder.

20. A method of forming a wheel including a hub and a see-through tire, said method comprising the steps of:

providing and inflating a bladder;

applying a first set of asymmetrical indicia on a first side surface of said inflated bladder such that said first set of asymmetrical indicia is visible when said inflated bladder is viewed from a first side, a mirror of said first set of asymmetrical indicia being visible from a second side;

applying a second set of asymmetrical indicia on a second side surface of said inflated bladder, opposite said first side surface of said inflated bladder, such that said second set of asymmetrical indicia is visible when said inflated bladder is viewed from a second side, said second set of asymmetrical indicia being a mirror image of said first set of asymmetrical indicia, a mirror image of said second set of asymmetrical indicia being visible from the first side;

positioning said inflated bladder on said hub; and molding a tire about a portion of said hub and about at least a portion of said inflated bladder with said first and second sets of asymmetrical indicia printed thereon.

21. The method of forming a wheel according to claim 20 further comprising the step of locating said infer bladder on said hub such that said inflated bladder is positioned above an outer surface of said hub.

22. The method of forming a wheel according to claim 20 wherein said molding step includes containing said inflated bladder within said tire.

23. The method of forming a wheel according to claim 20 wherein said tire and bladder are formed of see-through materials.

24. The method of forming a wheel according to claim 20 wherein said applying steps include stamping said first and second sets of asymmetrical indicia on said inflated bladder.

25. The method of forming a wheel according to claim 20 wherein said applying steps include printing said first and second asymmetrical indicia onto a surface of said inflated bladder.

26. The method of forming a wheel according to claim 20 wherein said applying steps include simultaneously pressing said first and second sets of asymmetrical indicia onto opposing surfaces of said inflated bladder.

27. The method of forming a wheel according to claim 20 wherein said applying steps include applying said first and second sets of asymmetrical indicia onto a surface of said inflated bladder using a pad.

28. The method of forming a wheel according to claim 20 wherein said applying steps occur simultaneously.

29. The method of forming a wheel according to claim 20 wherein said applying steps include applying portions of said second set of asymmetrical indicia so that they are offset from portions of said first set of asymmetrical indicia such that said offset portions of said second set of asymmetrical indica can be seen from both sides of said wheel.

30. A skate wheel comprising:

a hub for coupling a tire to an axle;

a see-through tire formed about a portion of said hub;

an element positioned within said see-through tire, said element including an inner side surface facing a first direction and an outer side surface facing a second direction, said second direction being opposite said first direction, said element including a first asymmetrical indicium on said outer side surface of said element such that said first asymmetrical indicium is visible when said element is viewed in the first direction and a mirror image of said first asymmetrical indicium is visible when said element is viewed in the second direction; and a second asymmetrical indicium on the inner side surface of said element such that said second asymmetrical indicium is visible when said element is viewed in the second direction and a mirror image of said second asymmetrical indicium is visible when said element is viewed in the first direction, said second asymmetrical indicium being a mirror image of said first asymmetrical indicium.

31. The skate wheel of claim 30, wherein said first asymmetrical indicium includes at least one alphanumeric character and the mirror image of said first asymmetrical indicium is not an alphanumeric character.

* * * * *

UNITED STATES PATENT AND TRADEMARK OFFICE

CERTIFICATE OF CORRECTION

PATENT NO. : 6,164,729
DATED : December 26, 2000
INVENTOR(S) : Christian Dibenedetto, et al.

It is certified that error appears in the above-identified patent and that said Letters Patent is hereby corrected as shown below:

Claim 1, Column 7,
Line 3, "firs" has been replace with the word -- first --.

Claim 20, Column 8,
Line 35, -- image -- has been inserted after the word "mirror".

Claim 21, Column 8,
Line 52, "infer" has been replace with the word -- inflated --.

Claim 25, Column 8,
Line 66, -- sets of -- has been inserted after the word "second".

Signed and Sealed this

Eighteenth Day of September, 2001

*Attest:*

Nicholas P. Godici

NICHOLAS P. GODICI
*Acting Director of the United States Patent and Trademark Office*

*Attesting Officer*